US005618371A

United States Patent [19]

Sing

[11] Patent Number: 5,618,371

[45] Date of Patent: Apr. 8, 1997

[54] METHOD OF PRODUCING LAMINATED WOOD BEAMS

[76] Inventor: Peter Sing, P.O. Box 11532, Winslow, Wash. 98110

[21] Appl. No.: 493,011

[22] Filed: Jun. 21, 1995

[51] Int. Cl.[6] ..... B27M 1/08

[52] U.S. Cl. ..... 156/264; 156/260; 52/731.1; 52/233; 144/345; 144/378

[58] Field of Search ..... 156/259, 260, 156/268, 264, 257; 144/344, 345, 346, 350, 351, 353, 354, 359, 363, 367, 368, 371, 376, 378; 52/233, 745.19, 730.1, 730.7, 731.1, 731.3, 731.4, 731.5

[56] References Cited

U.S. PATENT DOCUMENTS 5,115,609 5/1992 Sing ..... 52/309.9
5,332,461 7/1994 Huesler ..... 156/257

*Primary Examiner*—David A. Simmons
*Assistant Examiner*—Linda L. Gray
*Attorney, Agent, or Firm*—Nathaniel Altman

[57] ABSTRACT

A selective plurality of elongate half-logs, lumber planks which may have imperfect or damaged edges, or a combination of both, are superposed on each other and adhesively joined to form an intermediate assembly, which is then divided by one or more beam-long cuts made perpendicularly to the flat surfaces of the half-logs or planks. The resulting outer sections of the intermediate assembly, substantially mirror-images of each other, are reoriented so that the original outer edges face each other and are positioned so that a selected space remains between them. Various spacing and bracing elements are selectively chosen to connect the two outer sections and thus to form a laminated space-containing wood beam structure, on which surface-covering sheathing or coatings may be applied optionally.

19 Claims, 2 Drawing Sheets

METHOD OF PRODUCING LAMINATED WOOD BEAMS

FIELD OF THE INVENTION

This invention is directed to the production of laminated space-containing wood beams and related structural elements and to methods therefor, especially from unprocessed legs and lumber of less than top quality.

BACKGROUND OF THE INVENTION

In current practice, vast quantities of wood materials are under-utilized or discarded as being unfit for use in structural lumber. Logs in the range of an 8 inch diameter or less are considered to be too small for cutting into usable boards, planks or veneers. Planks cut from larger logs are rejected for first-quality applications when they have the defects of having waned, chipped or broken edges, or checked, cracked, split or even dry-rot surfaces.

This invention overcomes or neutralizes these deficiencies so that these less-than-perfect materials may be converted into high quality structural products lighter in weight and larger in size than conventional corresponding solid wood by reason of interior spaces therein, without sacrificing strength or appearance. All the defects and damages of the inferior materials are neutralized or concealed within the finished structural products. In addition, the methods of producing structural elements such as beams, joists, etc. disclosed and claimed herein are so highly efficient that they may be used even with first-quality undamaged starting materials to compete successfully in the marketplace against presently available beams or similar wood structural products.

It is a primary object of this invention to enhance the utility and value of small logs and imperfect lengths of lumber by creating high quality laminated structural beams, joists, etc., with interior space therein, at low cost and with little or no waste. It is another object of this invention to assemble these novel desirable lumber products efficiently and economically and thereby highly competitively in the structural wood products field, using the methods of this invention.

SUMMARY OF THE INVENTION

Small-diameter logs, bisected lengthwise into half-logs and flattened by trimming the rounded surface opposite the diametrically cut surface and parallel thereto, and precut planks which may have defective or damaged edges are the basic materials used to form the laminated space-containing wood beams of this invention. The half-logs, planks or combinations thereof are adhesively superposed in aligned stacks of two or more so that the upper and lower portions of the stacked assembly are wider than its central portion. Each stacked assembly is then cut vertically along its length to produce a pair of equally-sized mirror-image sections, which are arranged so that the original outer edges of the stacked intermediate assembly face toward each other in spaced relationship. Interior braces, spacers, outer covering layers or combinations thereof may be adhesively applied to hold the mirror-image sections together, and insulation materials and the like may be inserted into the remaining interior space before applying the covering layers, if any, to complete each laminated beam.

Details of all the preferred embodiments of this invention, and the methods used to create them, will be fully described in connection with the accompanying illustrative, but not limiting, drawings, wherein:

SHORT FIGURE DESCRIPTION OF DRAWINGS

DESCRIPTION OF THE PREFERRED EMBODIMENTS

Figure 1:
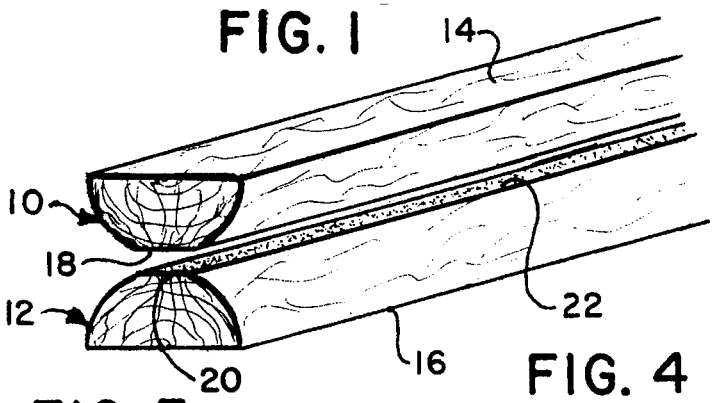
FIG. 1 is an end perspective partial view of two half-logs of this invention in position to be assembled.
Figure 2:
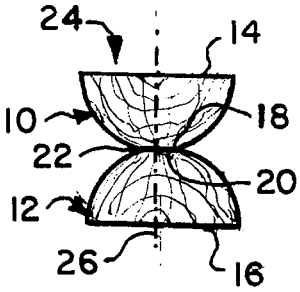
FIG. 2 is an end view of the two half-logs of FIG. 1 assembled and in position to be longitudinally bisected.
Figure 3:
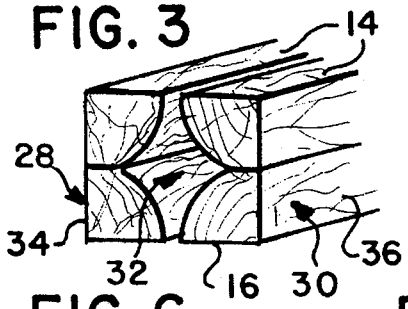
FIG. 3 is an end perspective partial view of the two sections cut as indicated in FIG. 2 spaced, and arranged in position to form a laminated beam structure in accordance with this invention.

FIGS. 1–3 illustrate two equal half-log lengths 10 and 12 with their respective diametrically cut flat surfaces 14 and 16 being the basic starting materials for the simplest form of this invention's laminated beam. Both half-logs 10 and 12 have been trimmed to produce flat surfaces 18 and 20 equal in width to each other, which are opposite and parallel to their respective diametric surfaces 14 and 16. In FIG. 1, half-logs 10 and 12 are in position to be joined together so that flat surfaces 18 and 20 are aligned and facing each other and having adhesive 22 applied to one or both of the facing surfaces.

In FIG. 2, half-logs 10 and 12 have been laminated together into intermediate assembly 24, which is to be vertically and longitudinally bisected along plane line 26. The two half-sections 28 and 30 are shown in FIG. 3, spaced from each other to leave interior space 32 therebetween and positioned so that their respective cut surfaces 34 and 36 are now turned away from each other and form the outer facings of assembly halves 28 and 30. The outer contour of halves 28 and 30 combined has assumed the rectangular cross-sectional shape of the to-be-assembled laminated beam of this embodiment of the invention. It should be noted that surfaces 14, 16, 34 and 36 may be smoothed by plane-milling or the like before, during or after the final assembly of the laminated beam structure.

Figure 4:
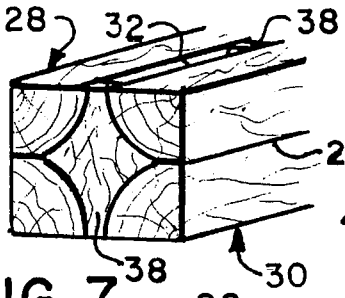
FIG. 4 is an end perspective partial view of the arrangement of FIG. 3 with vertically disposed bracing spacers connecting the two sections thereof at intervals along their length.
Figure 5:
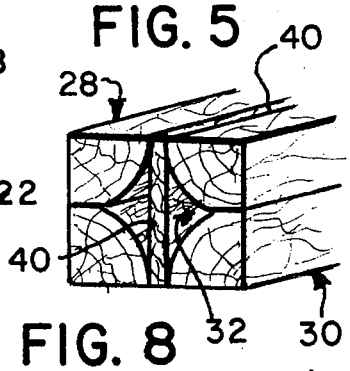
FIG. 5 is an end perspective partial view of the two sections of FIG. 3 held together by a vertically disposed spacer plank mounted therebetween and extending their entire length.
Figure 6:
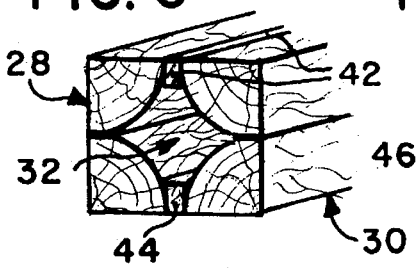
FIG. 6 is an end perspective partial view of the two sections of FIG. 3 held together by two vertically disposed beam-long spacers extending inwardly from the top and bottom surfaces of the assembly.

FIGS. 4–9 illustrate various support spacers for joining, strengthening and completing the beam structure assembly. In FIG. 4, a plurality of spacers 38, shaped complementarily to the outline of space 32, are positioned and secured adhesively at intervals along the length of the laminated beam. FIG. 5 shows vertically disposed spacer plank 40 installed between assembly halves 28 and 30, plank 40 extending the entire length of the assembled beam structure. In FIG. 6, the vertically oriented bracing spacers 42 and 44 extend inwardly from surfaces 14 and 16, respectively, partway into interior space 32 and longitudinally the length of the laminated beam assembly.

Figure 7:
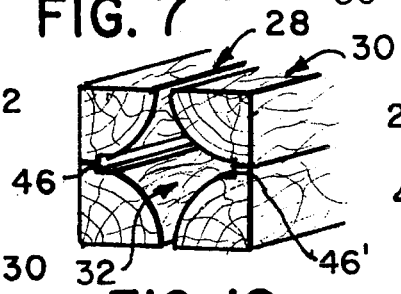
FIG. 7 is an end perspective partial view of the two sections of FIG. 3 modified by having centrally disposed opposite interior channels cut the length of the two sections.
Figure 8:
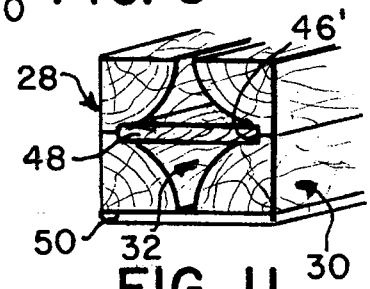
FIG. 8 is an end perspective partial view of the two sections of FIG. 7 assembled into a laminated beam structure with a horizontally disposed spacer plank occupying the interior channels thereof, and with top and bottom surface-facing elements in place.
Figure 9:
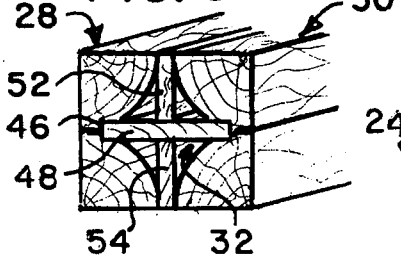
FIG. 9 is an end perspective partial view of the two sections of FIG. 3 similar to FIG. 8, but with a pair of vertically disposed beam-long spacers added.

In FIG. 7, intermediate assembly halves 28 and 30 have each been cut into to form beam-long centrally disposed opposite longitudinal channels 46, 46', provided to accommodate horizontal beam-long plank spacer 48 shown in FIG. 8, which also shows wood sheath 50 covering bottom surface 16 of the laminated beam structure, thus closing off the bottom of interior space 32. Obviously, this covering sheath 50 may be of any desired material in addition to wood, such as plywood, metal, plastic material, etc and may be applied as well to upper surface 14 and even to beam sides 28 and 30 and beam ends, if desired. The beam structure of FIG. 9 is different from that of FIG. 8 by the addition of beam-long vertical spacers 52 and 54 added for greater strength and stress resistance. Spacers 52 and 54 extend respectively from upper surface 14 and from bottom surface 16 inwardly to meet horizontal spacer plank 48.

Figure 10:
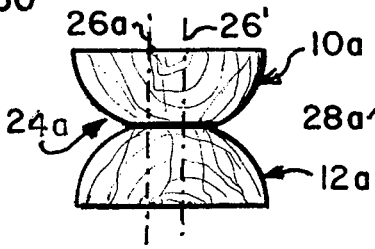
FIG. 10 is an end elevational view similar to FIG. 2 but using two larger diameter half-logs, in position to be divided by two vertical lengthwise cuts.
Figure 11:
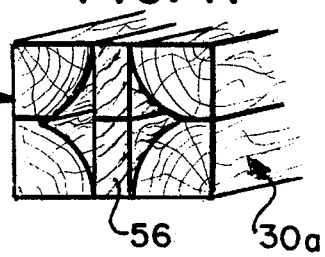
FIG. 11 is an end elevational view of another embodiment of this invention wherein the two sections have the beam-long laminated plank produced by the cuts of FIG. 10 adhesively connected therebetween.

FIG. 10 is a view of an embodiment similar to that of FIG. 2, but with half-logs 10*a* and 12*a* cut from a log somewhat larger in circumference than that of FIG. 2. Here, intermediate assembly 24*a* is to be cut along parallel vertical plane lines 26*a* and 26' to create two equal outer sections 28*a* and 30*a*, as shown in FIG. 11, The center portion of assembly 24*a* has been transformed into beam-long laminated plank 56, which may be used as a spacer between sections 28*a* and 30*a*, as seen in FIG. 11, or for any conventional plank use.

Figure 12:
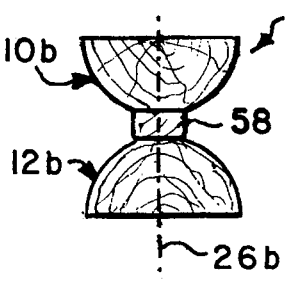
FIG. 12 is an end elevational view of two trimmed half-logs with a plank mounted therebetween in position to be bisected.
Figure 13:
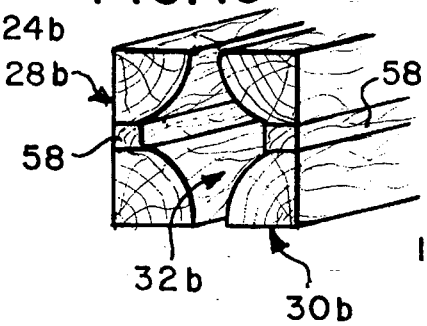
FIG. 13 is an end perspective partial view of the two sections produced by bisecting the structure of FIG. 12, in position to be secured together by one or more spacers.

The embodiment of FIG. 12 illustrates half-logs 10*b* and 12*b* with beam-length board 58 adhesively mounted therebetween in superposed stack assembly 24*b*. Vertical plane line 26*b* is shown herein to indicate the longitudinal path along which assembly 24*b* is to be bisected into resulting halves 28*b* and 30*b*, as shown in FIG. 13 with interior space 32*b* therebetween and in position for the final assembly of the laminated beam structure.

Figure 14:
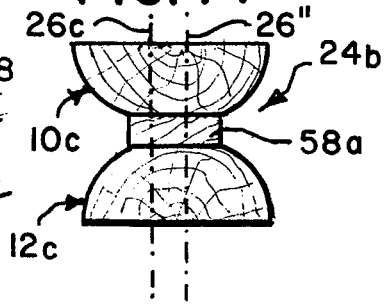
FIG. 14 is an end elevational view similar to FIG. 10, with a beam-long plank centrally mounted between two larger diameter half-logs, the assembly being in position to be divided by two vertical lengthwise cuts.

FIG. 14 shows intermediate assembly 24*c* closely resembling those of both FIGS. 10 and 12. Here, larger half-logs 10*c* and 12*c* have plank 58*a* adhesively mounted therebetween to form assembly 24*c*, which is to be divided by parallel vertical and longitudinal cuts along plane lines 26*c* and 26". Obviously, the resulting outer sections formed correspond exactly to sections 28*b* and 30*b* of FIG. 13 and may be used as described above, while center section 56*a* corresponds to laminated plank 56 of FIG. 11 and may be utilized in similar fashion thereto.

All the embodiments described above use half-logs as starting material; the embodiments which follow start with planks which may or may not have imperfect or damaged edges. The inferior quality planks will nonetheless produce a laminated beam of first quality.

Figure 15:
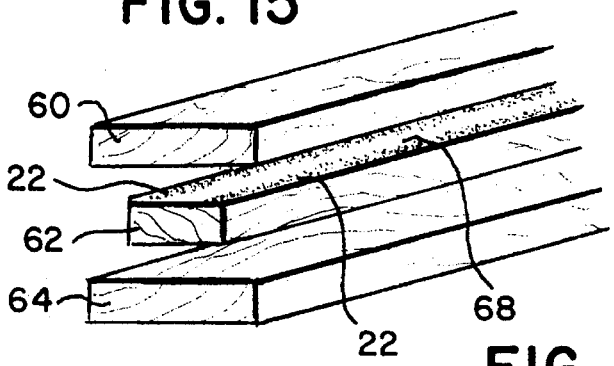
FIG. 15 is an end perspective partial view of three planks aligned and in position to be assembled in accordance with this invention.
Figure 16:
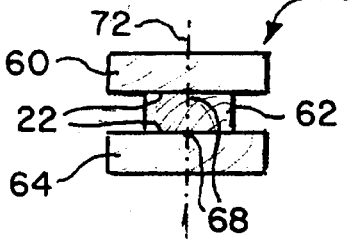
FIG. 16 is an end elevational view of the three planks of FIG. 15 now assembled and in position to be longitudinally bisected.

FIG. 15 shows three planks 60, 62 and 64 in superposed position to be assembled into the intermediate assembly 66 of FIG. 16. Planks 60 and 64 are substantially identical in length and width; plank 62, to be sandwiched between planks 60 and 64, is the same length, but narrower and is centrally aligned therebetween and selectively coated on both faces with adhesive 22, leaving a centrally disposed longitudinal stripe 68 of uncoated wood on each face thereof. When planks 60, 62 and 64 have been laminated together to form intermediate assembly 70, as shown in FIG. 16, adhesive 22 is absent from the area of the vertical plane line 72, along stripe 68 where assembly 70 is to be longitudinally bisected. Thus, the cutting action of bisecting the intermediate assembly will encounter no dried adhesive 22 to interfere therewith, and the resulting halves 74 and 76, shown spaced and reoriented in FIG. 17, will have no adhesive on the cut outer surfaces 78 and 80. The latter feature may be advantageous for the appearance and for trouble-free application of a finish on surfaces such as 78 and 80 in the finished laminated beam of this invention. Half-sections 74 and 76 are positioned to leave cross-shaped interior space 82, with parallel channels 84 and 86 extending the length of the to-be-assembled laminated beam.

Figure 17:
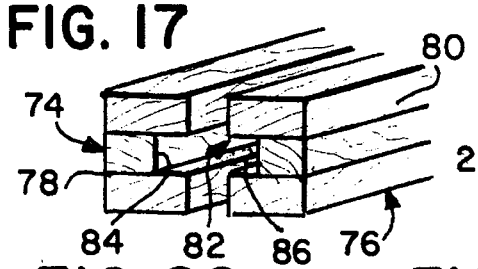
FIG. 17 is an end perspective partial view of the two outer sections already cut as indicated in FIG. 16, arranged and spaced in position to be connected to form a laminated beam structure in accordance with this invention.
Figure 18:
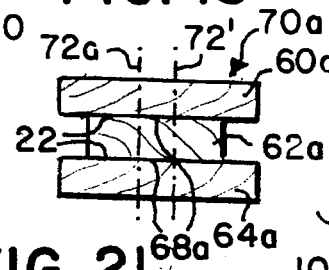
FIG. 18 is an end elevational view of an intermediate assembly similar to that of FIG. 16 but made with wider planks, in position to be divided into three sections by two parallel beam-long cuts.
Figure 19:
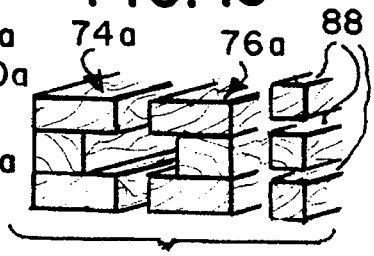
FIG. 19 is an end perspective partial view of the elements produced by the two vertical beam-long cuts of FIG. 18.

FIG. 18 illustrates another embodiment of the invention, with intermediate assembly 70*a* comprising planks 60*a*, 62*a* and 64*a*, all relatively wider than the corresponding planks of FIGS. 15–17. Assembly 70*a* is to be divided by parallel longitudinal cuts along planes 72*a* and 72'. A wide stripe 68*a* extending between cutting planes 72*a* and 72' has been left uncoated with adhesive 22 on the surface of plank 62*a*. The resulting elements created by these cuts are shown in FIG. 19. Herein, outer sections 74*a* and 76*a* are exactly like sections 74 and 76 of FIG. 17 in configuration and orientation and are positioned to be connected into a laminated beam in accordance with this invention. The center section of intermediate assembly 70*a*, because of the absence of adhesive in areas 68*a* of FIG. 18, becomes three separate and unlaminated wood strips 88 to be used as spacers or for conventional uses.

Figure 20:
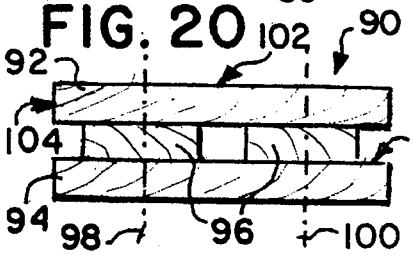
FIG. 20 is an end elevational view of two wide planks sandwiching two side-by-side narrower planks therebetween, in position to be cut into three sections.

The intermediate assembly 90 of FIG. 20 will produce two laminated beams. Wide planks 92 and 94 are adhesively attached respectively above and below two narrower planks 96 spaced in side-by-side relationship. When assembly 90 is cut longitudinally along vertical plane lines 98 and 100, the resultant center section 102 formed therefrom is a completed beam structure without further processing. Outer sections 104 and 106 are identical to sections 74 and 76 of FIG. 17, and, when reoriented, may be assembled into a finished beam structure just as the corresponding sections 74, 76 and 74*a*, 76*a* in FIGS. 17–19 as described above.

Figure 21:
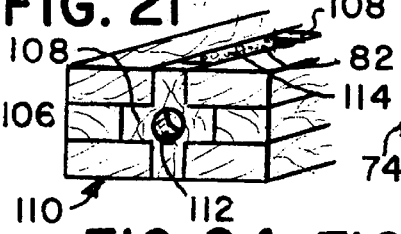
FIG. 21 is an end perspective partial view of a laminated beam assembly having cross-shaped bracing spacers placed at intervals along the length of the beam.
Figure 22:
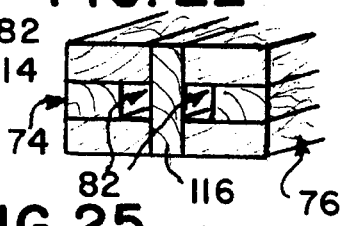
FIG. 22 is an end perspective partial view of a laminated beam structure with a vertically disposed beam-length spacer inserted therein.
Figure 23:
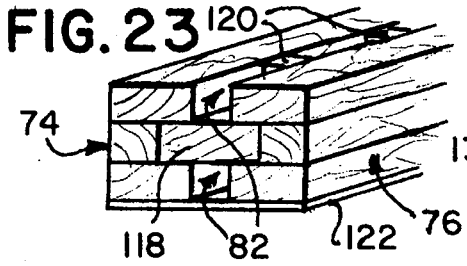
FIG. 23 is an end perspective partial view of a laminated beam assembly with a beam-length horizontally disposed spacing element combined with a plurality of vertically disposed spacers above and below the horizontal spacer and positioned at intervals along the beam.

FIGS. 21–23 illustrate various spacers inserted into and adhesively joined in interior space 82 to outer sections 74, 76 of FIG. 17 to hold together and strengthen the laminated beam structures formed therefrom. FIG. 21 shows a plurality of spacers 108 positioned at intervals along the length of completed beam structure 110. Each spacer 108 is shaped in the form of a cross, complementary to and fittingly inserted into interior space 82. A centrally disposed opening 112 in spacers 108 may be provided selectively for access into space 82 for insertion therein of pipes, conduits, etc. to carry utilities through beam 110. Also shown in FIG. 21 is insulation or similar material 114 inserted into interior space 82 between spacers 108; the placement of any of these materials shown illustratively in this embodiment may optionally and selectively be practiced with all the other beam embodiments in this specification. In FIG. 22, vertically disposed spacer 116 connects sections 74 and 76 and extends centrally through interior space 82 the entire length of the laminated beam structure.

The embodiment of FIG. 23 shows sections 74 and 76 joined, spaced and strengthened by horizontally disposed plank spacer 118 extending into and fittingly engaging channels 84 and 86. In space 82 above and below spacer 118, a plurality of supporting spacers 120 are positioned in vertical orientation at intervals along the laminated beam's length. In addition, plywood sheath layer 122 is shown illustratively as being mounted on the bottom surface of the laminated beam, closing off space 82 therein. As noted above in connection with FIG. 8, sheath surfacing elements of various materials may be applied to any or all the surfaces of the laminated beam.

Figure 24:
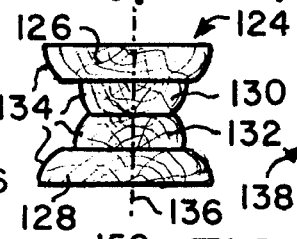
FIG. 24 is an end elevational view of two imperfectly edged wider planks at top and bottom, and two narrower planks in similar condition in between, all superposed and adhesively joined to each other, in position to be bisected.
Figure 25:
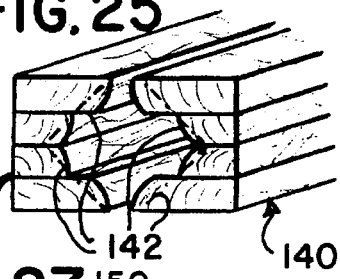
FIG. 25 is an end perspective partial view of the two sections formed by the bisecting cut of FIG. 24, in position to be assembled into a laminated beam structure, with four angular cut lines for straightening the walls of the interior space therein before assembly.
Figure 26:
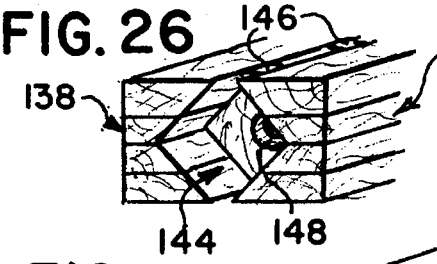
FIG. 26 is an end perspective partial view of the sections of FIG. 25 after cutting and being assembled into a laminated beam structure by insertion of interior contour-following spacers at intervals along the length of the laminated beams.

In FIG. 24, intermediate assembly 124 has four planks with irregular edges adhesively superposed in aligned fashion on one another. Top and bottom planks 126 and 128 are wider than centrally positioned planks 130 and 132, and all four planks have imperfect edges 134 which may be waned, chipped or damaged in other ways. Plane line 136 designates the cutting path along which assembly 124 is to be bisected. The resultant sections 138 and 140 are rearranged in FIG. 25, as with the previously described embodiments so that imperfect edges face inwardly and may be provided with channels as in the embodiment of FIG. 7, or, as shown in FIG. 25, may have irregular edges 134 trimmed along cut lines 142 to define a generally diamond-shaped rectangular space 144 (FIG. 26) therebetween. A plurality of bracing spacers 146, diamond-shaped to engage the trimmed walls of interior space 144 fittingly, are positioned at intervals along the assembled laminated beam. Each spacer 146 may have a centrally disposed opening 148, to be used in the manner described in connection with opening 112 in FIG. 21.

Figure 27:
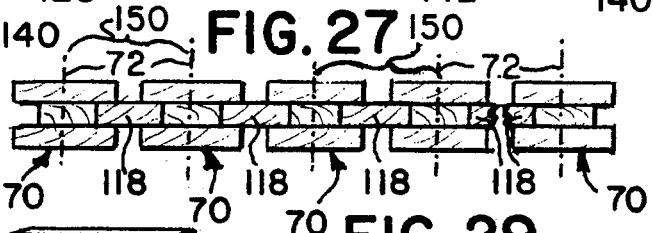
FIG. 27 is an end elevational view of a horizontal spaced row of a plurality of plank assemblies shown in FIG. 16.

FIG. 27 illustrates a highly efficient cost-saving procedure for rapid production of laminated beams. A series of intermediate assemblies 70 (see FIG. 16) are spaced in a horizontal row and each is joined to its adjacent neighbor by horizontal spacer planks 118 (FIG. 23). When longitudinal cuts are made along vertical plane lines 72, each of the sections 150 produced thereby between adjacent cut lines are already assembled beam structures; only the extreme end half-sections remain to be connected in the manner shown in FIGS. 16 and 17.

Figure 28:
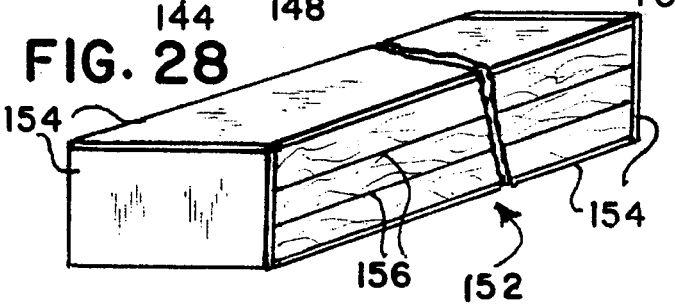
FIG. 28 is an end perspective view, partially broken away, of a completed laminated space-containing beam in accordance with this invention.
Figure 29:
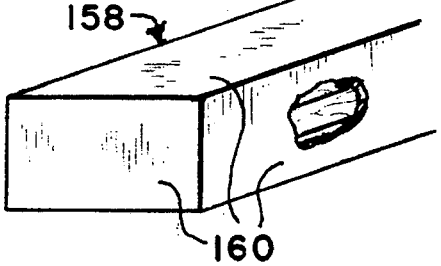
FIG. 29 is an end perspective partial view of a completed laminated beam surfaced on all faces with a protective coating.

The finished laminated beam 152 illustratively shown in FIG. 28 has covering sheaths 154 overlying top, bottom and end surfaces thereof. Front and rear surfaces may also have sheathing applied to conceal lamination lines 156, if desired. A variety of materials may be used selectively for sheathing 154, including, for example, wood, plywood, artificial wood formed from aligned wood fibers dispersed in highly resistant synthetic resin, metal sheeting, plastic sheeting, fabric or the like. FIG. 29 displays a laminated, beam 158 completely covered with a unitary sheath 160 made of plastic, as shown, or other highly resistant coating materials.

The adhesive 22 used in all the various embodiments is preferably of the cold-setting synthetic resin type, although other available types may be used successfully. It should also be noted that creating designs in the laminated beams of this invention is possible. Thus, by using half-logs or planks of different wood species having varying colors and combining them, attractive beams having multiple colors may be produced. Also, by using half-sections of intermediate assemblies of different wood species the outer facing of a laminated beam might be of a weather-resistant species, while the opposite face of the same beam might be selected to be an attractively grained wood interior surface.

The various preferred embodiments and the best methods of producing them as now contemplated have been fully described herein. It will be evident to one skilled in the art that modifications, substitutions and combinations other than those described may be made without departing from the concepts of the invention disclosed herein, which are limited only by the scope of the ensuing claims, wherein:

What is claimed is:

1. A method of producing a laminated space-containing wood beam from two elongate equal-length log portions and at least one pre-cut lumber plank of equal length to, and narrower in width than the widest dimension of the two log portions, all cut from at least one log, the log portions and the at least one plank all having parallel planar lower and upper surfaces, which comprises the steps of:

applying adhesive selectively to to-be-joined surfaces of the two log portions and the at least one plank;

superposing and aligning the two log portions, with the at least one pre-cut plank in centrally aligned position therebetween;

putting the to-be-joined surfaces, having adhesive thereon, together so that the two log portions and the at least one plank are assembled in a vertical symmetrically stacked pile;

causing the adhesive to set, thereby forming an intermediate assembly, the two elongate log portions being so configured and dimensioned that the intermediate assembly is wider at the top and bottom and narrower at the center portion and is symmetrical in cross-section;

making longitudinal cuts through the intermediate assembly along an axis perpendicular to the parallel planar surfaces of the two log portions to form outer sections, the outer sections thus formed being substantially equal-sized, asymmetric mirror-images of each other;

positioning the outer sections cut from the intermediate assembly into spaced relationship wherein the outer edges of the two log portions of the intermediate assembly now face each other; and adhesively attaching at least one bracing spacer means for maintaining the outer sections in the spaced relationship position to complete the laminated space-containing wood beam structure.

2. The method of producing a laminated space-containing wood beam defined in claim 1, further comprising the step of inserting into an interior space remaining between the outer sections and bracing spacer means at least one of the following selected from the group consisting of insulation, strengthening materials, conduits for carrying water, conduits for carrying electricity, and conduits for carrying gas.

3. The method of producing a laminated space-containing wood beam defined in claim 1, wherein the two log portions comprise half-logs cut diametrically and longitudinally from at least one log, and having a diametrically cut surface, each half-log having been trimmed to form a planar surface opposite and parallel to the diametrically cut surface, the opposite planar surface of one half-log having been superposed, aligned with, and adhesively joined to the upper surface of the pre-cut plank, the lower surface of the pre-cut plank having been superposed, aligned with, and adhesively joined to the opposite planar surface of the other half-log to form the intermediate assembly.

4. The method of producing a laminated space-containing wood beam defined in claim 3, further comprising the step of cutting an approximately C-shaped channel longitudinally and centrally in each arcuately-shaped vertical wall of each outer section so that when the outer sections are positioned in the spaced relationship, the C-shaped channels face each other, the C-shaped channels accept fittingly the edges of the at least one bracing spacer means.

5. The method of producing a laminated space-containing wood beam defined in claim 1, wherein the at least one bracing spacer means is selected from the group consisting of sheathing means covering at least one surface of the assembled laminated beam structure, at least one bracing spacer means secured at intervals along the length of the outer sections and dimensioned to contact facing outer sections and at least one of bracing spacing means extending the entire length of the outer sections and dimensioned to contact facing outer sections, and any combination of the above.

6. The method of producing a laminated space-containing wood beam defined in claim 1, wherein the step of making longitudinal cuts along an axis perpendicular to the parallel planar surfaces of the at least two log portions comprises a single, centrally disposed cut.

7. The method of producing a laminated space-containing wood beam defined in claim 1, wherein the step of making longitudinal cuts along an axis perpendicular to the parallel planar surfaces of the at least two log portions comprises a pair of parallel cuts, leaving two outer sections and a central section therebetween where the central section comprises at least one elongate piece of lumber rectangular in cross-section.

8. The method of producing a laminated space-containing wood beam defined in claim 7, wherein the step of applying adhesive selectively comprises placing the adhesive on the to-be-joined surfaces so that the central section created by the pair of parallel cuts is selected from the group consisting of a single laminated elongate rectangular piece of lumber, and at least two separate unglued elongate rectangular pieces of lumber.

9. The method of producing a laminated space-containing wood beam defined in claim 1, wherein the at least two elongate log portions and the one pre-cut lumber plank have defective, imperfect, and irregular edges.

10. A method of producing laminated space-containing wood beams from a plurality of intermediate assemblies each formed from more than two elongate lumber planks cut from at least one log, each intermediate assembly has top and bottom planks which are wider than at least one plank to be positioned between the top and bottom planks, which comprises:

applying adhesive selectively on to-be-joined surfaces of the planks for each assembly;

superposing and aligning the planks in each assembly;

putting the to-be-joined surfaces, having adhesive thereon, together so that the planks in each assembly are assembled in a vertical pile;

causing the adhesive to set to form each intermediate assembly;

placing a plurality of intermediate assemblies in an evenly-spaced horizontal row;

inserting and adhesively securing at least one bracing spacer means between adjacent intermediate assemblies;

making a single longitudinal cut along an axis perpendicular to the planks' surfaces and bisecting each intermediate assembly, whereby all but the extreme left and right sections of the row resulting from these cuts form assembled laminated space-containing wood beams; and placing the extreme left and right sections in reverse orientation to form a second evenly-spaced horizontally row, inserting and adhesively securing at least one bracing spacer means between the extreme left and right sections to form a laminated space-containing wood beam.

11. The method of producing laminated space-containing wood beams defined in claim 10, wherein the at least one bracing spacer means is selected from the group consisting of a plurality of cross-shaped bracing spacer means positioned at intervals along the length of adjacent intermediate assemblies to fittingly engage the facing walls of the adjacent intermediate assemblies; a vertically disposed plank bracing spacer means contacting the top and bottom planks of adjacent intermediate assemblies and extending vertically to the top and bottom surfaces of the adjacent intermediate assemblies; a horizontally disposed plank bracing spacer means extending across a space between adjacent intermediate assemblies and into channels in each intermediate assembly between the top and bottom planks; a pair of horizontally disposed beam bracing spacer means, one connecting the top planks of adjacent intermediate assemblies and the other connecting the bottom planks of adjacent intermediate assemblies, with an outer surface of each bracing spacer means aligned with respective top and bottom surfaces of the adjacent intermediate assemblies; and a plurality of substantially rectangular bracing spacer means positioned at intervals along the length of adjacent intermediate assemblies above and below, a horizontally disposed plank bracing spacer.

12. The method of producing laminated space-containing wood beams defined in claim 10, further comprising the step of inserting into an interior space remaining in the assembled laminated space-containing wood beams at least one of the following selected from the group consisting of insulation, strengthening elements, and conduits for utilities.

13. The method of producing laminated space-containing wood beams defined in claim 10, further comprising the step of adhesively applying to at least one of the surfaces of each assembled laminated space-containing beams, a covering element selected from the group consisting of wood paneling, plywood paneling, artificial wood sheathing made from aligned wood fibers dispersed in synthetic resin, metal sheeting, plastic sheeting, fabric, and resistant coating materials.

14. A method of producing a laminated space-containing wood beam, having top and bottom planks and at least one plank therebetween, from more than two pre-cut lumber planks, each with parallel planar surfaces, the top and bottom planks being wider than the at least one plank positioned therebetween, which comprises the steps of:

applying adhesive selectively on to-be-joined surfaces of the planks;

superposing and centrally aligning the planks;

placing the to-be-joined surfaces of the planks, having adhesive thereon, together to form a balanced, centered, and vertically stacked pile;

causing the adhesive to set, thereby forming an intermediate assembly, substantially symmetrical in cross-section;

making longitudinal cuts through the intermediate assembly along an axis perpendicular to the parallel planar surfaces of the pre-cut planks to form outer sections, the outer sections thus formed being substantially equal-sized, asymmetric mirror-images of each other;

positioning the outer sections cut from the intermediate assembly into spaced relationship wherein the outer edges of the more than two pre-cut lumber planks of the intermediate assembly now face each other; and adhesively attaching at least one bracing spacer means for connecting, supporting, and maintaining the outer sections in the spaced relationship position to complete the laminated space-containing wood beam structure.

15. The method of producing a laminated space-containing wood beam defined in claim 14, further comprising the step of inserting into the interior space remaining between an outer sections and bracing spacer means at least one of the following selected from the group consisting of insulation, strengthening materials, conduits for carrying water, conduits for carrying electricity, and conduits for carrying gas.

16. The method of producing a laminated space-containing wood beam defined in claim 14, wherein the bracing spacer means is selected from the group consisting of sheathing covering at least one surface of the assembled laminated beam structure, a plurality of bracing spacer means secured at intervals along the length of the outer sections and dimensioned to contact facing outer sections and at least one bracing spacer means extending the entire length of the outer sections and dimensioned to contact facing outer sections, and any combination of the above.

17. The method of producing a laminated space-containing wood beam defined in claim 14, wherein the longitudinal cuts along an axis perpendicular to the planar surfaces of the pre-cut lumber planks to form outer sections, is a single, centrally disposed cut.

18. The method of producing a laminated space-containing wood beam defined in claim 14, wherein the step of making longitudinal cuts comprise a pair of parallel cuts leaving two outer sections and a central section therebetween where the central section comprises at least one elongate piece of lumber of rectangular cross-section.

19. The method of producing a laminated space-containing wood beam defined in claim 14, wherein the more than two pre-cut lumber planks have knots and defective, irregular, and imperfect edges.

* * * * *